United States Patent [19]

Hilfman et al.

[11] 4,402,825

[45] Sep. 6, 1983

[54] METHOD FOR THE REMOVAL OF METAL ALKARYL SULFONATE FROM HYDROCARBONS

[75] Inventors: Lee Hilfman, Mt. Prospect; Thomas P. Malloy, Lake Zurich; Russell W. Johnson, Villa Park, all of Ill.

[73] Assignee: UOP Inc., Des Plaines, Ill.

[21] Appl. No.: 344,445

[22] Filed: Feb. 1, 1982

[51] Int. Cl.[3] ..... C10G 29/10; C10G 29/04

[52] U.S. Cl. ..... 208/237; 208/253

[58] Field of Search ..... 208/253, 237; 166/266, 166/267

[56] References Cited

U.S. PATENT DOCUMENTS

| | | | |
|---|---|---|---|
| 4,261,812 | 4/1981 | Newcombe | 166/267 |
| 4,274,943 | 6/1981 | McClaflin | 208/181 |
| 4,277,352 | 7/1981 | Allison et al. | 166/266 |

*Primary Examiner*—Delbert E. Gantz
*Assistant Examiner*—Cynthia A. Prezlock
*Attorney, Agent, or Firm*—James R. Hoatson, Jr.; John G. Cutts, Jr.; William H. Page, II

[57] ABSTRACT

A method of removing metal alkaryl sulfonate from a hydrocarbon solution is disclosed. Briefly, the method comprises contacting the hydrocarbon solution containing metal alkaryl sulfonate with basic anion-exchange resin and recovering a hydrocarbon having a reduced concentration of metal alkaryl sulfonate.

7 Claims, No Drawings

METHOD FOR THE REMOVAL OF METAL ALKARYL SULFONATE FROM HYDROCARBONS

BACKGROUND OF THE INVENTION

The method described herein is applicable to the removal of metal alkaryl sulfonates from a hydrocarbon solution of the sulfonates. A typical hydrocarbon which is contaminated with such sulfonates is petroleum crude oil.

Aqueous solutions containing metal alkaryl sulfonates are used in the enhanced oil recovery (EOR) of petroleum crude oil from subterranean formations. The petroleum crude oil is recovered concurrently with an aqueous phase and after the separation of the aqueous phase from the crude oil, a substantial amount of sulfonate remains in the crude oil portion. The crude oil may be contaminated with sulfonates in an amount from about 10 to 5000 parts per million by weight, or more. The metal alkaryl sulfonates are often referred to as surfactants. The metal alkaryl sulfonate which contaminates the recovered crude oil must be removed or substantially reduced before the crude oil undergoes any further refining and processing. The presence of sulfonate in the crude oil during subsequent processing may cause corrosion, environmental pollution and/or hydrorefining catalyst poisoning.

Since enhanced oil recovery is becoming widespread in the oil production industry, the problem of surfactant contaminated crude oil is well known. Candor compels the acknowledgment that those skilled in the art are working in many directions to solve the problem. For example, U.S. Pat. No. 4,274,943 (McClaflin) teaches a method for the removal of metal alkaryl sulfonates from a hydrocarbon solution thereof which method comprises (a) contacting the hydrocarbon solution containing metal alkaryl sulfonates with an aqueous basic solution containing a "recovery" surfactant, (b) forming a hydrocarbon phase and an aqueous phase containing metal alkaryl sulfonates and (c) separating the hydrocarbon phase and the aqueous phase. U.S. Pat. No. 4,274,943 is one method which the prior art utilizes to separate or extract metal alkaryl sulfonates from recovered petroleum crude oil and is incorporated herein by reference thereto.

We have discovered a novel and effective method of removing metal alkaryl sulfonates from hydrocarbons including petroleum crude oil. The method of the present invention will be described in detail hereinafter.

BRIEF SUMMARY OF THE INVENTION

The present invention relates to a method for the removal of metal alkaryl sulfonate from hydrocarbons. Accordingly, one embodiment of the present invention is a method for the removal of metal alkaryl sulfonate from a hydrocarbon solution containing the same, which method comprises: (a) contacting a hydrocarbon solution of metal alkaryl sulfonate with basic anion exchange resin; and (b) recovering a hydrocarbon having a reduced concentration of metal alkaryl sulfonate.

Other embodiments and objectives of our invention encompass details about sulfonates, ion-exchange resin, preferred hydrocarbons, and operating conditions, all of which are hereinafter disclosed in the following discussion of each of the facets of the invention.

DETAILED DESCRIPTION OF THE PRESENT INVENTION

The present invention comprises steps for the removal of metal alkaryl sulfonate from a hydrocarbon solution thereof. More specifically the invention concerns the removal of metal alkaryl sulfonate from petroleum crude oil which has been recovered by the use of tertiary oil recovery techniques. Tertiary recovery or what may be referred to as enhanced oil recovery (EOR) is the extraction of crude oil which remains in place after the primary oil recovery and secondary oil recovery with water in an oil field is completed. One method for enhanced oil recovery is to flood the subterranean formations with an aqueous solution of metal alkaryl sulfonate and to remove the crude oil. As hereinabove described, the recovered petroleum crude oil contains trace quantities of sulfonates. Although the method of the present invention may be utilized for the removal of sulfonates from hydrocarbons in general, the preferred hydrocarbons are the petroleum crude oils which have been contaminated with sulfonates during an enhanced oil recovery procedure.

However, our process is also applicable to liquid hydrocarbons, either pure or mixtures thereof, containing from about 6 to about 18 carbon atoms. The hydrocarbons can be straight-chain or branched-chain. In order to be liquid, it is necessary that the hydrocarbon containing higher carbon atoms (e.g. above $C_{12}$) contain branched-chain materials. With mixtures of hydrocarbons containing higher carbon atoms, it is necessary that a larger amount of branched-chain hydrocarbons be present.

Many different types of metal alkaryl sulfonates may be employed for the enhanced oil recovery of petroleum crude oil. One type of metal alkaryl sulfonates is represented by the following formula:

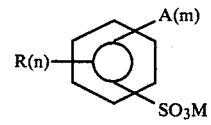

wherein

A = hydrogen or a $C_1$–$C_4$ alkyl group m = 1 or 2 when A is alkyl

R = C9–$C_{18}$ alkyl group n = 1 or 2

M = alkali metal when A is hydrogen, m = 1 when A is alkyl the maximum number of carbon atoms in A(m) is 4, and the total number of carbon atoms in A(m) and R is in the range of 12 to 22.

One particular sulfonate is a sodium mono- or dialkyl benzene sulfonate wherein the alkyl group contains from 9 to 18 carbon atoms. Anothersulfonate is a sodium dialkyl benzene sulfonate with an average equivalent weight of 430. Although a myriad of metal alkaryl sulfonates and mixtures thereof having the above formula exist and may be used for enhanced oil recovery, the present invention may be used to remove any of these or any other metal alkaryl sulfonates from hydrocarbons. Hydrocarbons sitable for use with the present invention preferably contain from about 10 to about 10,000 wt. ppm metal alkaryl sulfonate.

The process of the present invention utilizes basic anion exchange resins to effect the removal of metal alkaryl sulfonates from hydrocarbons. In general, ion exchange may be defined as the reversible interchange of ions between a solid and a liquid phase in which there is no permanent change in the structure of the solid. The solid is the ion-exchange material. The utility of ion-exchange rests with the ability to use and reuse the ion-exchange materials. Ion-exchange resins consist of two principal parts, a structural portion (polymer matrix) and a functional portion (ion-active group). The wide variety of ion-exchange-resin formulations and properties derives from various combinations of these parts.

There are at least four principal producers of ion-exchange resins in the United States with each distributing product under his own or other trade names. The following is a listing of four producers of resins and their respective trademarks:

| | Trademark |
|---|---|
| Diamond Alkali Co. | Duolite |
| The Dow Chemical Co. | Dowex |
| Ionac Chemical Corp. | Ionac |
| Rohm & Haas Co. | Amberlite |

The synthesis of an organic ion exchanger involves the chemical substitution of an ion-active group and a polymerization reaction. The sequence of events may be in either order. For example, early sulfonic resins based on a cross-linked phenolic matrix were prepared either by sulfonation of phenol-formaldehyde polymers (Amberlite 1R-100), or by condensation of phenolsulfonic acid with formaldehyde (Dowex 30), or by alkaline condensation of sodium phenoxide, sodium sulfite, and formaldehyde (Amberlite IR-1).

Regardless of type of ion-exchange resin, the source, the method of manufacture or other particulars, the method of the present invention simply requires the use of what is known as basic anion-exchange resin. Typical examples of basic anion-exchange resin include Amberlite IRA-900C, IRA-900C(OH), IRA-420C+OH, IRA-400 and Dowex 1-X1 to Dowex 1-X10(Cl).

According to the present invention, the hydrocarbon solution of metal alkaryl sulfonate is contacted with the basic anion-exchange resin at conditions which preferably include a temperature from about 75° F. to about 400° F., more preferably from about 100° F. to about 250° F. and a pressure from about ambient to 500 psig, more preferably from about ambient to about 250 psig. This contacting may be accomplished by using the resin in a fixed bed system, a moving bed system, a fluidized bed system, any of which may be a continuous or a batch type operation. It is preferred to use a fixed bed system.

Generally the contact time in the ion-exchange zone is determined by degree of sulfonate removal desired. Preferred contact times range from about 0.1 to about 100 hours and more preferably from about 0.1 to about 20 hours.

In a fixed bed system, the hydrocarbon solution of metal alkaryl sulfonate is maintained at or heated to the desired temperature and passed into an ion-exchange zone containing basic anion-exchange resin. It is, of course, understood that an ion-exchange zone may be one or more separate vessels or zones with suitable means therebetween to ensure that the desired temperature is maintained at the entrance to each ion-exchange zone. It is also important to note that the hydrocarbon may be contacted with the ion-exchange resin in either upward, downward, or radial flow fashion.

In a preferred embodiment of the present invention, the ion exchange is performed in the presence of water. The crude oil or hydrocarbon may contain entrained water or additional water may be added to the ion-exchange zone. Either source of water is suitable for the present invention. The water may preferably be present in an amount from about 0.01 to about 20 volume percent based on the hydrocarbon, more preferably from about 0.1 to about 10 volume percent.

Spent ion-exchange resin or ion-exchange zones containing spent resin may be regenerated by ion exchange to remove the sulfonate anion and recover metal alkaryl sulfonate. The recovered metal sulfonate may then be reused, if desired. In the event that the ion-exchange resin which is selected is in the chloride or hydroxide form, the regeneration may be performed with an aqueous sodium chloride solution or an aqueous sodium hydroxide solution, respectively. Other techniques and regeneration schemes for ion-exchange resin are well known in the art.

After the hydrocarbon has contacted the ion-exchange resin to reduce the concentration of the metal alkaryl sulfonate, the hydrocarbon may be further processed or utilized in other known procedures or processes. After the hydrocarbon has been treated according to the method of the present invention, it is preferable that the hydrocarbon be contacted with an aqueous medium to remove water soluble salts which are indigenous to the hydrocarbon or which have been formed during the ion exchange. This contacting is similar to the desalting operation which is routinely carried out in petroleum refineries before a virgin crude oil is subsequently processed in the refinery.

The method of the present invention is further illustrated by the following example which is a preferred embodiment and is not intended as an undue limitation on the generally broad scope of the invention as set out in the appended claims.

EXAMPLE

A vacuum column resid was selected to demonstrate a preferred embodiment of the present invention and an inspection of the resid is presented in Table I.

TABLE I

Inspection of Vacuum Column Resid Containing Sodium Alkaryl Sulfonate

| | | |
|---|---|---|
| API Gravity at 60° F. | 13 | |
| Distillation (D-1160) | | |
| IBP, °F. | 826 | |
| 5% | 902 | |
| 10% | 939 | |
| 30% | 1004 | |
| EP | 1004 | (34%) |
| Viscosity | | |
| Kinematic @ 122° F. | 425.8 | |
| Sulfur, wt. % | 0.6 | |
| Nitrogen, wt. % | 0.39 | |
| Conradson Carbon, wt. % | 10.8 | |
| Heptane Insolubles, wt. % | 5.38 | |
| Salt as NaCl, lbs/M Bbls | 295 | |
| Arsenic, ppm | 1 | |
| Metals by Emission, ppm | | |
| Fe | 63 | |
| Ni | 4.9 | |
| V | 13 | |
| Pb | 5.9 | |
| Cu | 0.89 | |
| Na | 540 | |
| Mo | 0.1 | |

TABLE I-continued

| Inspection of Vacuum Column Resid Containing Sodium Alkaryl Sulfonate | |
|---|---|
| Ca | 150 |
| Mg | 16 |
| Methylene Blue Test, wt. % | 0.69 |

This vacuum resid had a sodium alkaryl sulfonate content of 0.69 weight percent as measured by the standard Methylene Blue Test. About 231 cc (227 grams) of the hereinabove described vacuum resid was added to 130 grams of a strongly basic anion-exchange resin, which was manufactured by the Rohm & Haas Co., sold under the trademark of Amberlite and designated IRA-938. The admixture of the sulfonate-contaminated vacuum resid and the basic anion-exchange resin was stirred overnight at 140° F. Then 248 cc of toluene was added to the admixture to facilitate filtering.The vacuum resid was then recovered by vacuum filtration.

The recovered vacuum resid was analyzed by the Methylene Blue Test and was found to contain 0.035 wt.% sodium alkaryl sulfonate. The basic anion-exchange resin removed 94.9% of the sulfonate from the vacuum resid. Another indication of the removal of the sodium alkaryl sulfonate from the vacuum resid was the reduction of sodium from 544 weight ppm to 17 weight ppm by contacting the resid with the resin.

The foregoing specification and example clearly illustrate the improvements encompassed by the present invention and the benefits to be afforded therefrom.

We claim:

1. A method for the removal of metal alkaryl sulfonate from a hydrocarbon solution containing the same, which method comprises:

(a) contacting a hydrocarbon solution of metal alkaryl sulfonate with solid basic anion-exchange resin; and (b) recovering a hydrocarbon having a reduced concentration of metal alkaryl sulfonate.

2. The method of claim 1 wherein said hydrocarbon is crude oil.

3. The method of claim 1 wherein said metal alkaryl sulfonate is present in the hydrocarbon solution in an amount from about 10 parts per million by weight to about 10,000 parts per million by weight.

4. The method of claim 1 wherein step (a) is performed at a temperature from about 100° F. to about 250° F.

5. The method of claim 1 wherein step (a) is performed at a pressure from ambient to about 250 psig.

6. The method of claim 1 wherein step (a) is conducted in the presence of water.

7. The method of claim 6 wherein said water is present in an amount from about 0.01 to about 20 volume percent based on the hydrocarbon.

* * * * *